US005651463A

United States Patent [19]

Major et al.

[11] Patent Number: 5,651,463

[45] Date of Patent: Jul. 29, 1997

[54] ENCLOSED PALLET SYSTEM

[76] Inventors: Daniel E. Major, 2609 Greenberry La., Knoxville, Tenn. 37938; L. Bryan Yarnell, 1721 Dawn Redwood Trail, Knoxville, Tenn. 37922

[21] Appl. No.: 634,566

[22] Filed: Apr. 18, 1996

[51] Int. Cl.[6] ..... B65D 19/06

[52] U.S. Cl. ..... 206/599; 108/53.3; 108/55.1; 206/600

[58] Field of Search ..... 108/51.1, 53.3, 108/55.1, 55.3, 56.1; 206/386, 595–600

[56] References Cited

U.S. PATENT DOCUMENTS

| | | | |
|---|---|---|---|
| 1,690,853 | 11/1928 | Behrman . | |
| 3,443,737 | 5/1969 | Kupersmit . | |
| 3,770,186 | 11/1973 | Kupersmit . | |
| 4,550,830 | 11/1985 | Shuert . | |
| 4,936,451 | 6/1990 | Shuert | 206/598 |
| 5,109,985 | 5/1992 | Rose . | |

*Primary Examiner*—Jimmy G. Foster
*Attorney, Agent, or Firm*—Luedeka, Neely & Graham, P.C.

[57] ABSTRACT

An enclosed pallet unit comprises an assembly of two basic components that are twin sheet molded from high density polymer sheet material. Substantially identical pallet platforms serve as both the floor and roof of the assembly. A plurality of substantially identical load bearing wall units are slide bolt locked to both the floor and roof pallet platforms. Each load bearing wall unit is divided into two, twin sheet panels that are joined longitudinally by a strip portion of the opposite side sheets being fused together to form a hinge axis. A wall unit is socketed in receptacle channels adjacent each corner respective to the floor and roof pallets with each panel of a respective wall unit radiating substantially 90° from the panel hinge axis. Additional wall units may be used midway along either or both pairs of pallet edges with one panel of each wall unit aligned parallel with the pallet edge and the other panel of a respective unit turned substantially 90° to the pallet edge.

12 Claims, 11 Drawing Sheets

ENCLOSED PALLET SYSTEM

BACKGROUND OF THE INVENTION

Field of the Invention

The present invention relates to large article transport platforms. In particular, the present invention relates to shipping pallet systems that enclose the shipped article with vertical load supporting walls.

Transport platforms having a bottom support pallet and a top cap separated by a load bearing perimeter wall are known to the prior art. Depending on the design emphasis, such enclosed transport platforms provide security from pilferage, loss and damage of the enclosed articles, environmental protection and/or vertical stacking capacity. In most cases, the design anticipates a corrugated paper wall in one form or another. Additionally, the assembly is frequently complex with numerous components. Although corrugated paper may be adequately strong when dry and unabused, the material loses strength exponentially with the absorption of moisture. Complex assemblies are time consuming to erect and the loss or destruction of any one of many components can render the entire composition unusable.

One objective of the present invention therefore is to provide a moisture impervious pallet enclosure system.

Also an objective of the present is to provide an enclosed, load bearing pallet system having a minimum of individual components.

A further objective of the present invention is to provide an enclosed pallet system of general application having only two large and durable components.

Another objective of the present invention is to provide a specialized, cradled article, shipping pallet system having only three large and durable components.

A still further object of the present invention is to provide a collapsible system for enclosed pallets that may be manually erected by a single worker in only 2–3 minutes.

A yet further object of the present invention is to provide a collapsible system for enclosed pallets in which all the components may be nested or densely stacked for return shipment and reuse.

SUMMARY

These and other objects of the invention are accomplished by an enclosed pallet unit in which the floor and roof of the enclosure are substantially identical rectangular platforms having surface skins molded from two sheets of high density polymer. One of the pallet skins is molded to form bottom support blocks which provide fork tine clearance between the remainder of the pallet bottom skin and the support surface. The upper or inside pallet skin is molded to form a multiplicity of parallel ribs. The two skins are fused together at selected points to form an integral unit of stiffening ribs and load supporting, void spaced, skin elements. Around the pallet perimeter radiating from each pallet corner adjacent the pallet edge are respective channels that socket or laterally confine respective wall panel ends. A structured boss element is formed in each of the upper skin channels to socket into a corresponding notch in the matching wall panel end. The boss elements are punched or cut open to receive assembly bolts that are confined within the wall panels.

Another twin sheet platform identical to the bottom platform previously described is inverted for an enclosure roof with the bottom support blocks projected upwardly or away from the interior of the pallet unit enclosure.

The two platforms respectively socket opposite ends of four or more wall units which each carry internal assembly slide fastener bolts. When closed, the slide bolts form a shear bolt attachment point between each platform and a respective end of each wall unit.

The wall units also are twin sheet formed of high density polymer, preferably with substantially symmetrically spaced, opposite side skins. About midway of the wall width, the skins are fused together along a strip that corresponds to the wall height. This fused strip may be moderately flexed about an axis to function as a hinge between two adjacent and integral wall panels. One of these panels is assigned to each of the four pallet corners with the wall panel hinge axis substantially connecting the top and bottom platform corner points. From the hinge axis, the two wall panels radiate at 90° from each other along the respective platform edges and within the platform channels. Notches in these wall panel socket edges fit with the platform assembly bosses. Slide bolts confined between the wall panel skins adjacent the panel notches are slide positioned to a shear pin alignment between a respective notch and boss.

DESCRIPTION OF THE PREFERRED EMBODIMENT

Figure 1:
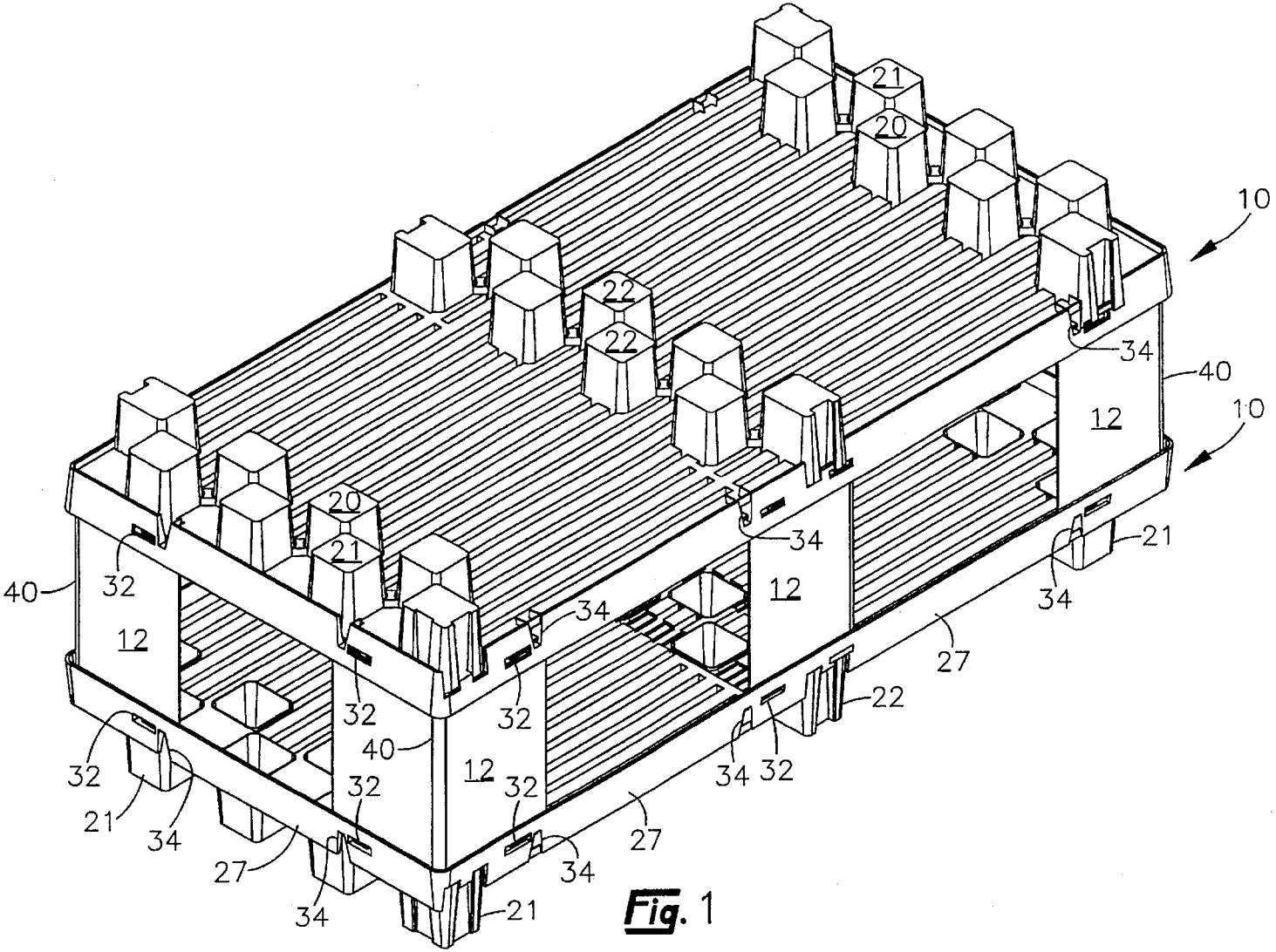
FIG. 1 is a perspective view of the invention as an assembled pallet unit.
Figure 6:
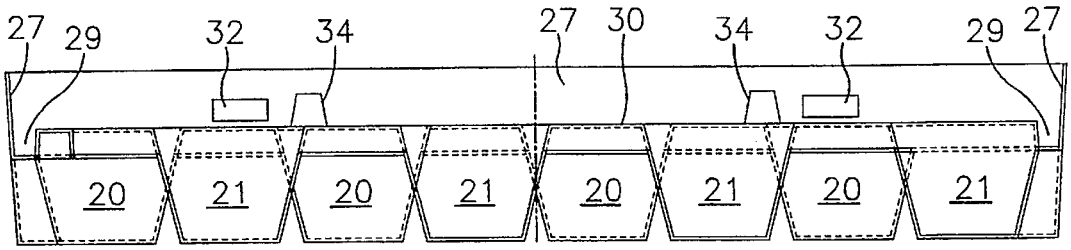
FIG. 6 is a cross-sectional elevation of the invention platform element viewed along cutting planes 6—6 of FIG. 3.
Figure 2:
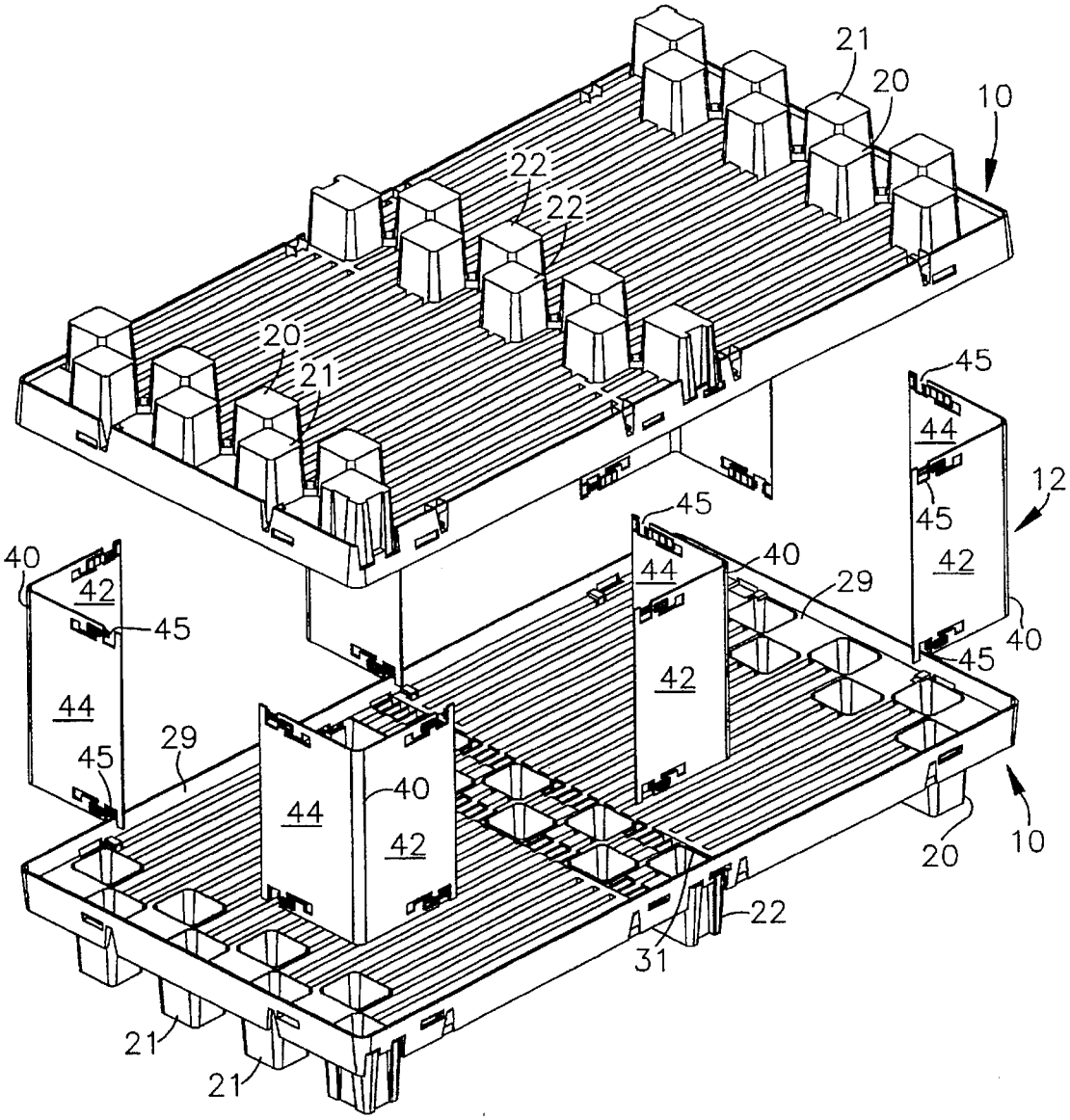
FIG. 2 is an exploded perspective view of the invention.

Relative to the Drawings wherein like reference characters describe like or similar elements throughout the several figures of the Drawing, the pictorials of FIGS. 1 and 2 illustrate a pallet unit as comprising a pair of platforms 10 spaced by several corner walls 12. Both platforms 10 are substantially identical but relatively inverted to set the respective corrugated support of doors of the platform pair in facing opposition and the respective support blocks 20, 21 and d22 projecting oppositely and outwardly.

Separating the pair of oppositely facing platforms 10 are four to six wall units 12 with their respective panels 42 and 44 turned at 90° to each other about respectively connecting binges 40. It is important to note that these platforms and wall units represent the major components of the invention.

Figure 3:
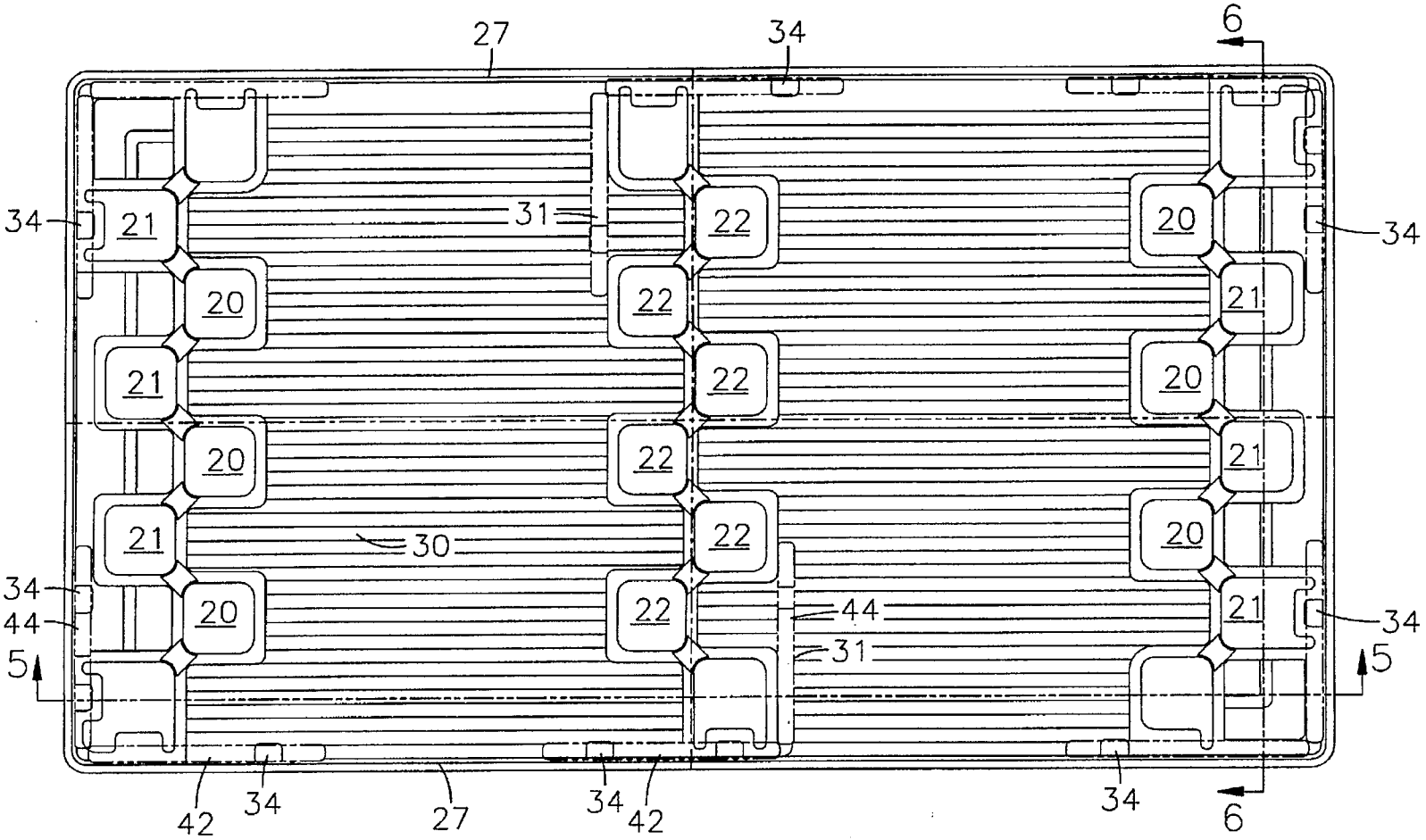
FIG. 3 is a top or inside plan view of the platform element of the present invention.
Figure 5:
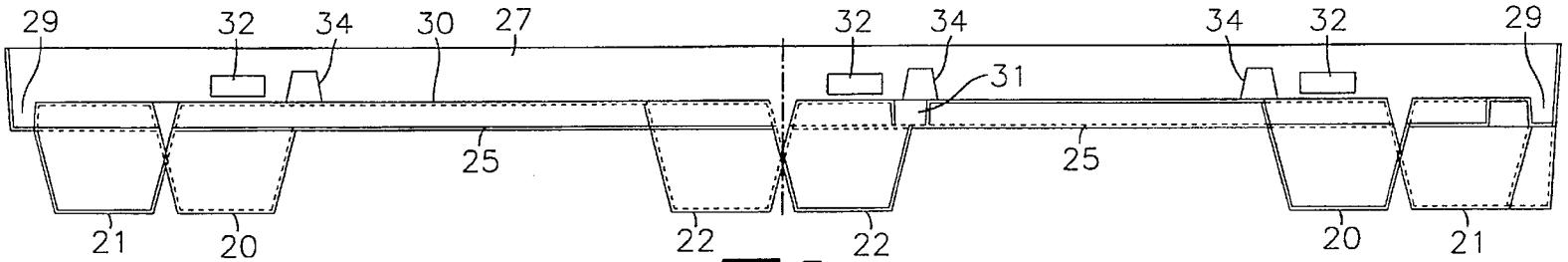
FIG. 5 is a cross-sectional elevation of the invention platform element viewed along the cutting planes 5—5 of FIG. 3.
Figure 4:
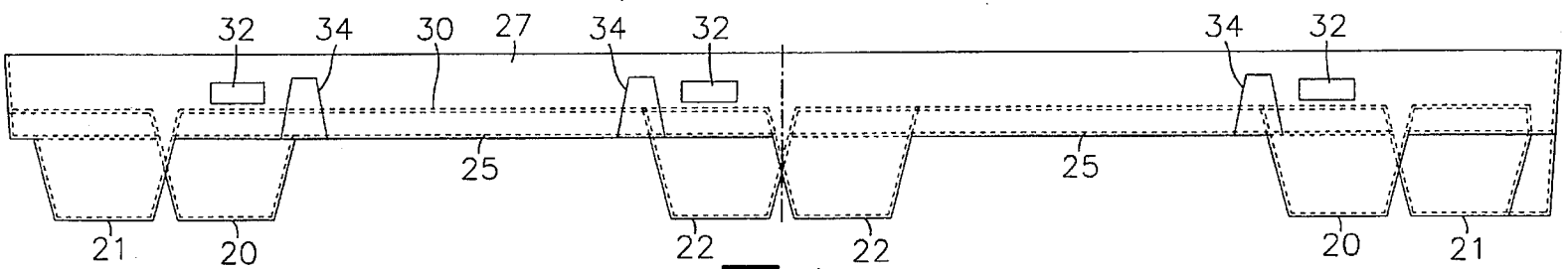
FIG. 4 is a side elevation view of the platform element of the present invention.

FIGS. 3, 4 and 5 illustrate the pallet platform 10 of the present assembly as comprising two sheets of high density polymer 25 and 30 that are distinctively molded separately as opposite side skins that are fused together at selected points with void spaces between the skins elsewhere.

With respect to the plan of FIG. 3, the platform 10 comprises three transverse rows of legs or support surface blocks. The blocks along the opposite ends of the platform are aligned in offset denticulations with an inside row 20 and an outside row 21. In the case of a rectangular planform for the invention platform to be used in the transport of dense, heavy articles, a center row of denticulated blocking 22 may also be provided. Such blocking supports the platform base skin 25 above the respective fixed support surface for access by lift truck tines not shown. Such tines are conveniently inserted under the platform 10 between the end rows of support blocks and the center row of blocks.

The platform 10 perimeter is defined by a lip 27 which forms the outer wall of a perimeter channel 29 between the lip 27 and a corrugated floor 30. Additionally, the lip 27 is provided a number of window shaped apertures 32, ten in this embodiment, set equidistantly from each platform corner, or transverse centerline. Relative to each window 32, a wedge shaped boss 34 is thermoformed from the lip 27 material and plane and pushed into the channel 29 thereby interrupting the channel continuity. The boss 34 sides, in the plane of the channel 29, are cut with lock bolt receiver openings 36.

Figure 7:
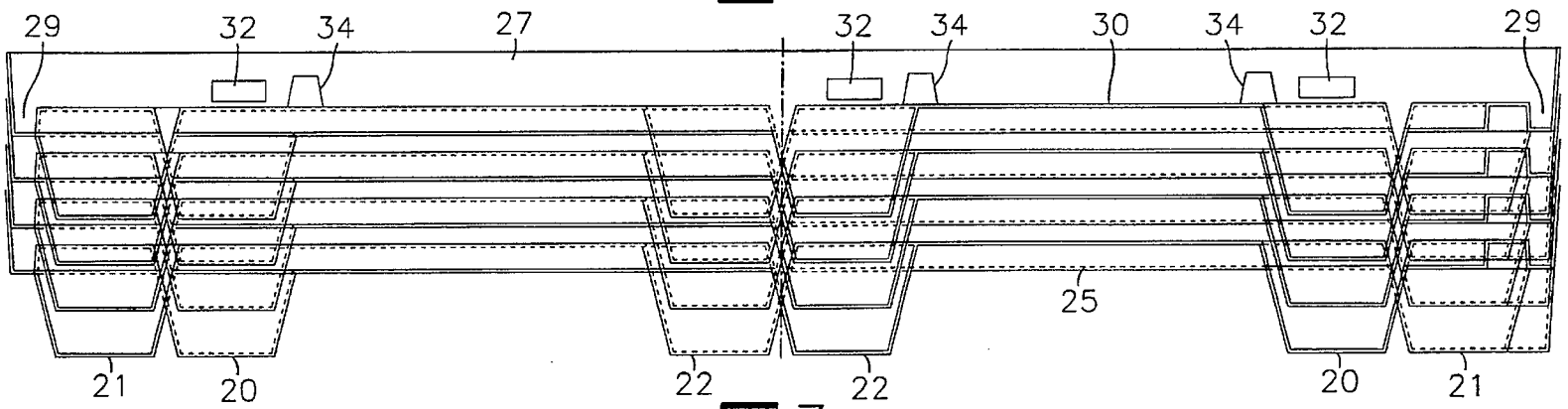
FIG. 7 is a cross-sectional elevation of several of the invention platforms in a nested stack.

A highly desirable characteristic for reusable industrial shipping pallets is dense nesting for return transports. This capacity for the present invention platforms 10 is illustrated by FIG. 7 showing a sectional elevation of four such platforms that are vertically stacked with the support blocks 20, 21 and 22 of each platform penetrating the upper or inside void of the corresponding blocks below.

Figure 8:
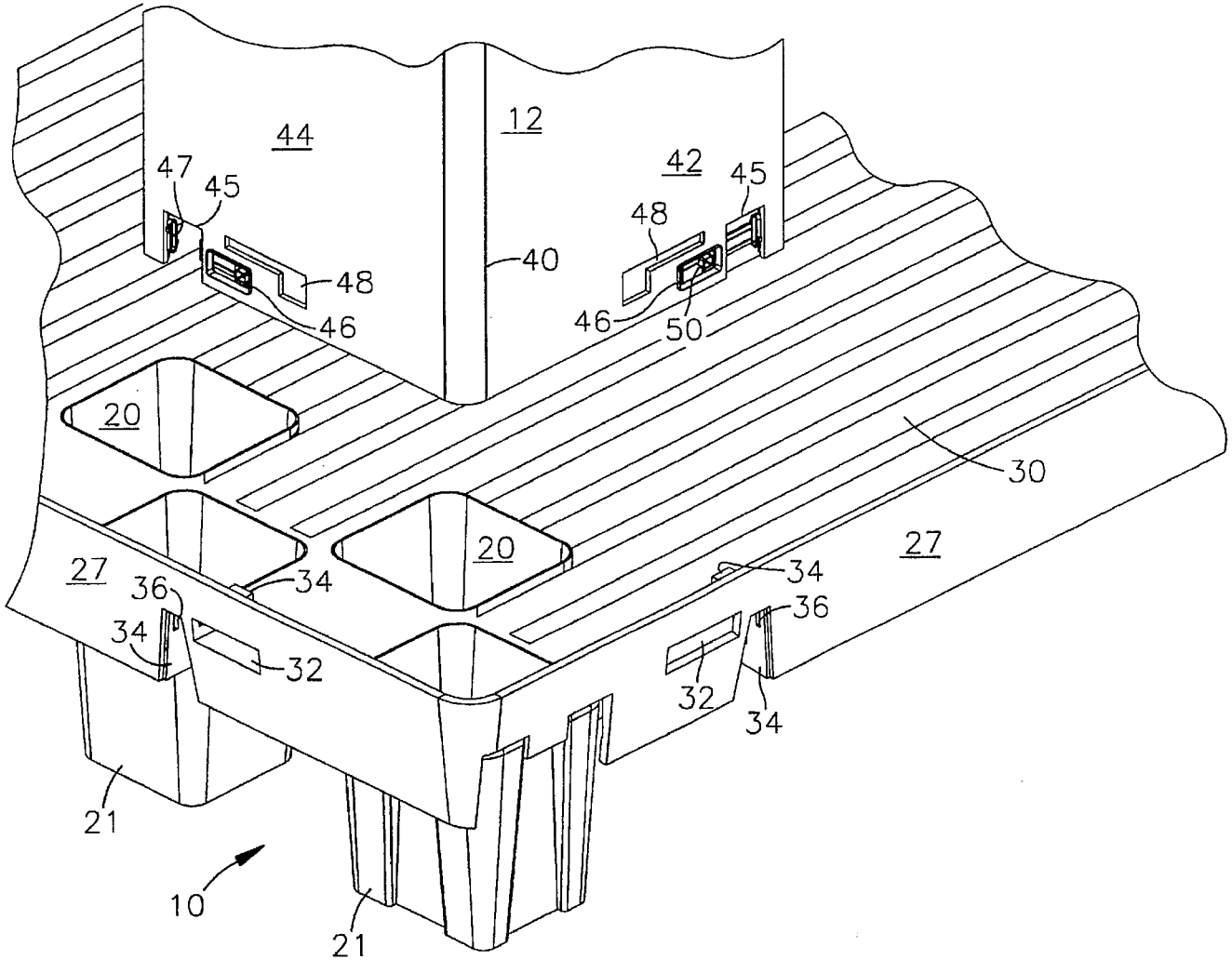
FIG. 8 is a partial perspective view of the invention showing ht two major components in exploded relationship.
Figure 9:
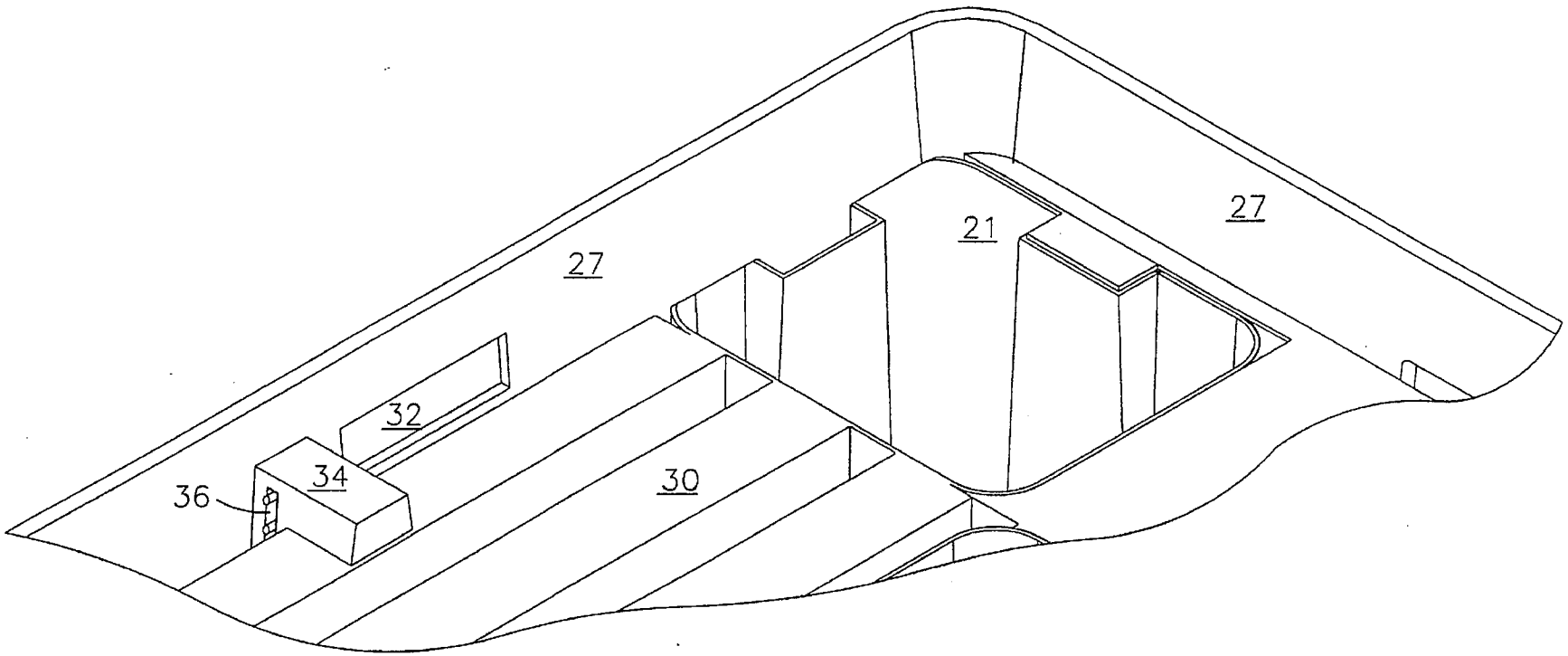
FIG. 9 is a partial perspective view of the invention showing an inside corner portion of the invention platform.

With respect to FIGS. 8 and 9, a wall unit 12 is twin sheet formed from two thermoplastic sheets positioned in spaced, parallel plane alignment to form an inside skin 38 and an outside skin 39. A peripheral band of these skins is turned inward and thermally pressed to form a perimeter edge band corresponding to the skin plane separation distances.

Additionally, a center hinge 40, formed by fusing the inside and outside sheets together along a narrow, longitudinal band, flexibly joins two panels 42 and 44 of a wall unit. Preferably, this center hinge band 40 is dimensioned to permit a 180° flexure of one wall panel relative to the other for disassembled compaction. It is essential, however, that the panels 42 and 44 be relatively flexible over a 90° relative rotational arc.

The top and bottom edges of each panel are notched as represented by gap space 45 which is dimensioned to socket over a channel boss 34 with the flexure axis of a hinge 40 at the proximate platform corner. The peripheral band joining the inside and outside wall panel sheets continues into and around the notch space 45. Like the boss 34, the notch 45 perimeter is opened with lock bolt receiver apertures 47 on oppositely facing aperture edges.

Figure 10:
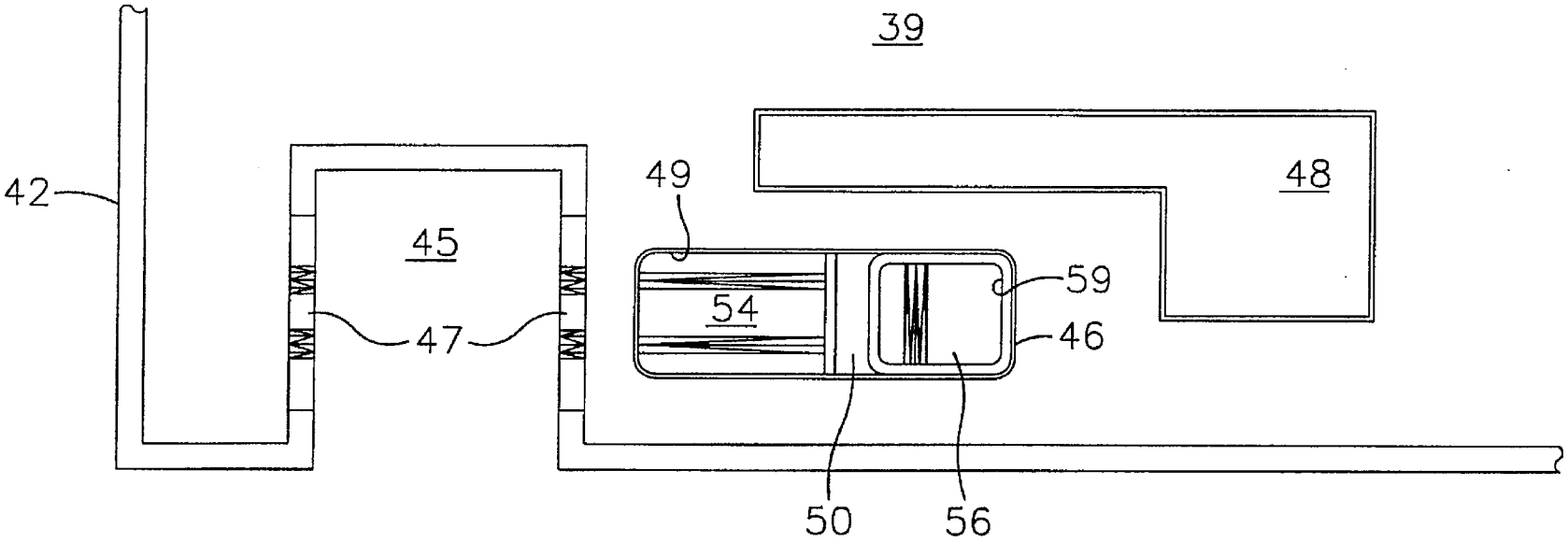
FIG. 10 is a front elevation view of the present invention.

Shown by FIG. 10, an elongated rectangular aperture 49 in the outer skin 39 of wall panel 42 is provided laterally of the receptacle notch 45 to access and guide a respective locking bolt 50. With respect to FIGS. 11, 12 and 13, the locking bolts 50 each comprise a hilt 52, a blade 54, a tool socket 56 and a pair of detent notches 57. Detent ridges 58 formed in the adjacent portion of the inner wall panel 38 cooperate with the bolt detent notches 57 to secure the bolt 50 at a desired position of either engaged or disengaged.

The tool socket 56 of the bolt 50 provides a convenient means to manually engage the bolt for reciprocative sliding within a confinement pocket between the inner and outer skins. The socket recess is bounded by a square ridge 59 which projects from the outer face of the bolt hilt 52 and has a loose sliding fit within the wall aperture 49. Bolt 50 is restricted to longitudinal reciprocal movement between the inside and outside wall skins. The releif or depression area 48 in the outside wall skin 39 provides a packet wall or web between the inside and outside wall skins to prevent movement of the tool socket ridge 56 from alignment within the wall skin aperture 49.

Figure 13:
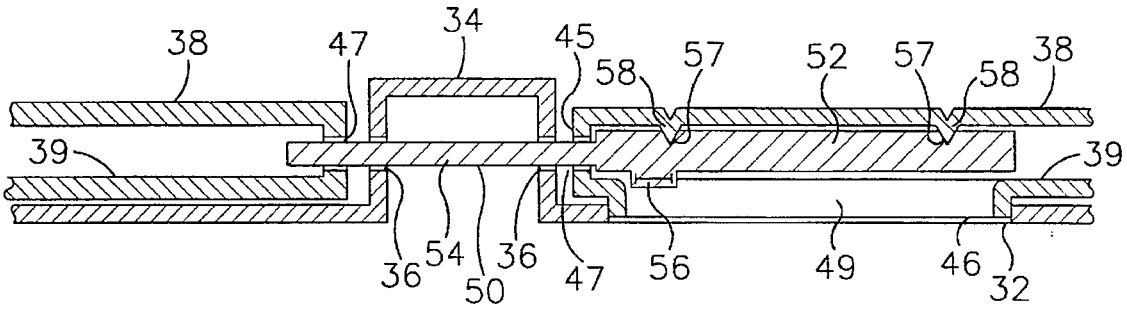
FIG. 13 is a secontal view of the component assembly fastener system.
Figure 14:
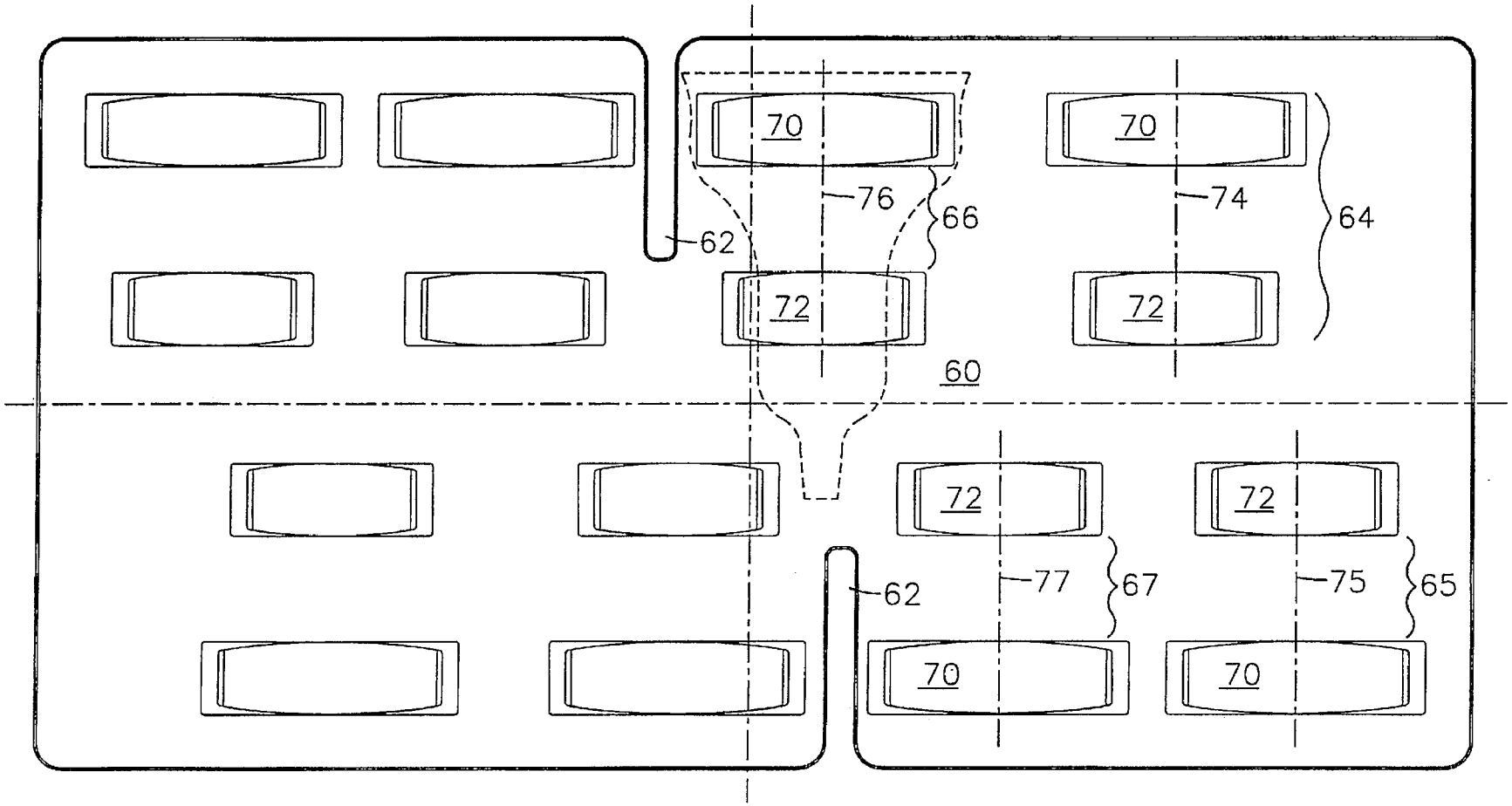
FIG. 14 is an top plan view of an automotive transmission cradle insert for the present invention.
Figure 15:
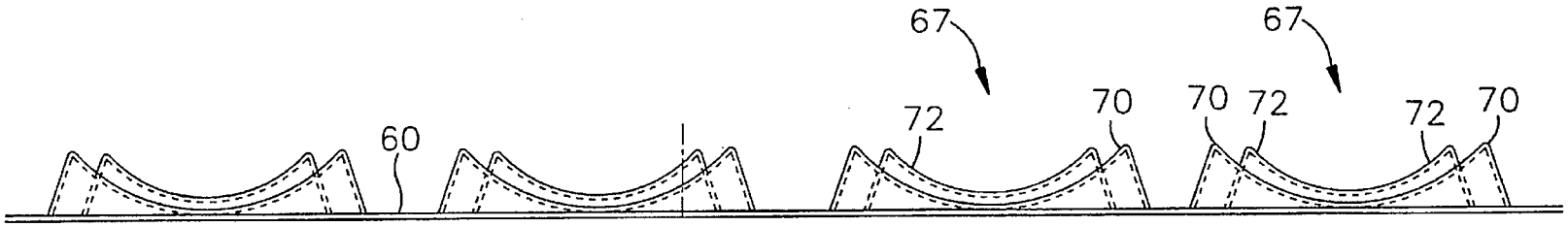
FIG. 15 is an elevational side view of the transmission cradle insert.
Figure 16:
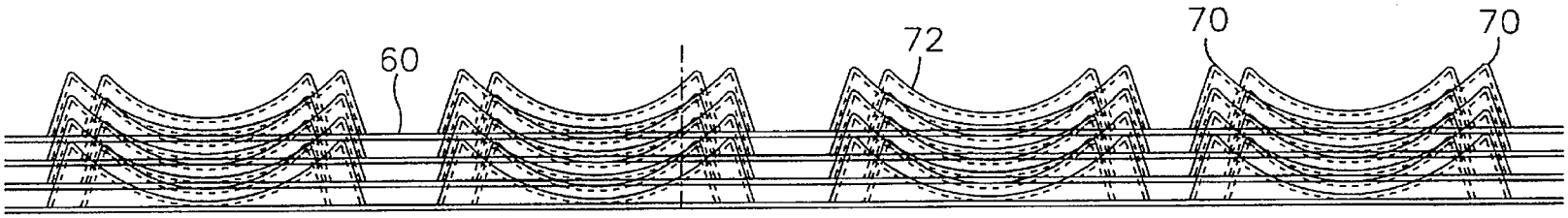
FIG. 16 is an elevational side view of four transmission cradle inserts for the invention in a nested stack.
Figure 17:
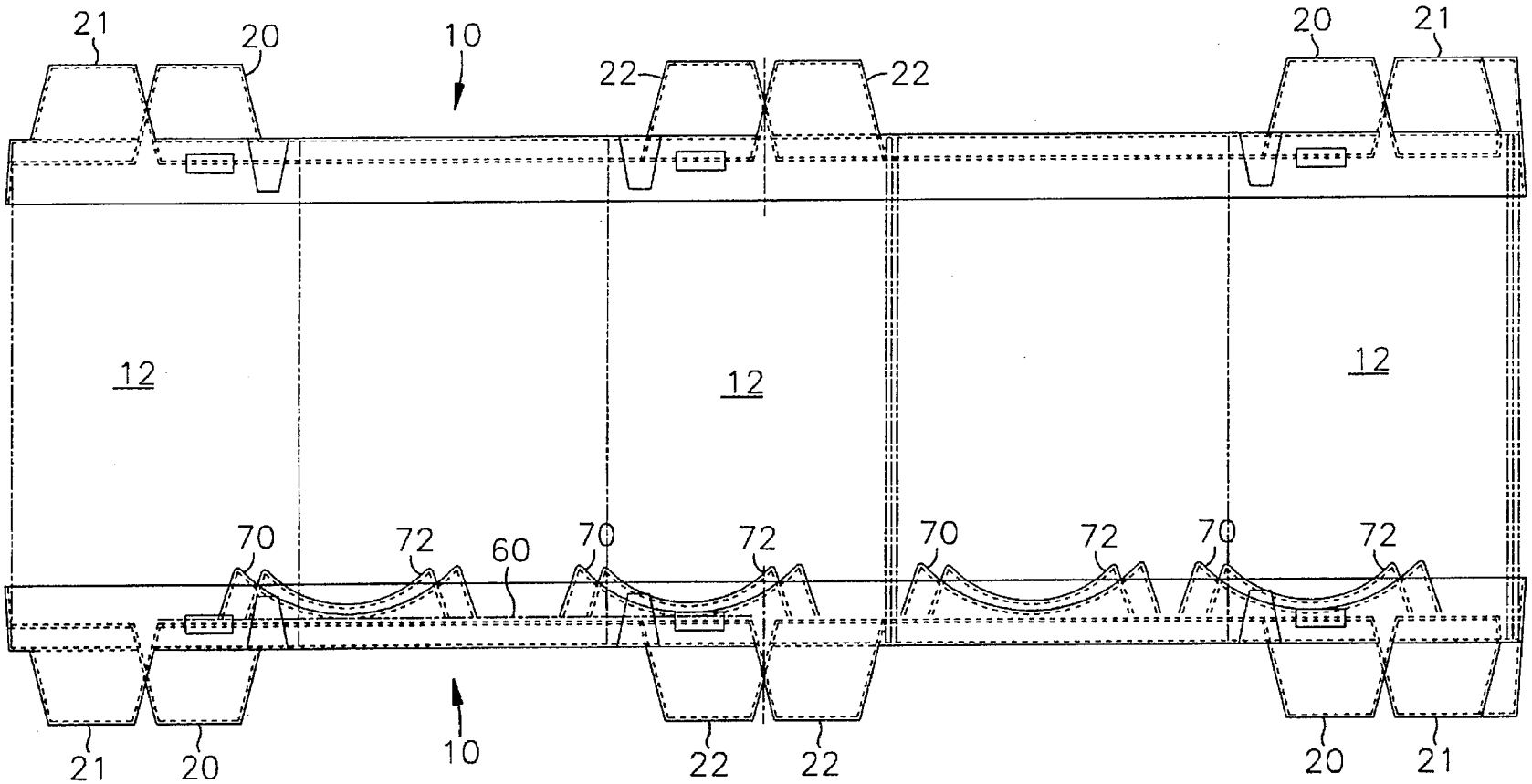
FIG. 17 is a side elevational assembly view of the present invention in phantom line portrayal.

Additionally, as best seen from FIG. 13, the lock aperture 49 is bounded by a flared perimeter 46. This flared opening is a consequence f a depression thermoformed in the skin 39 and subsequently cut along the depression perimeter wall. The lock aperture 32 in the platform perimeter 27 is dimensioned to receivew the fare 46 therein as shown by FIG. 13.

Although not illustrated, it will be appreciated by those of ordinary skill that the aperture 32 in the platform perimeter lip 27 may also be flared in the manner such as described for aperture 49 and flared perimeter 46. A depression is thermoformed in the perimeter lip 27 and the depression base severed from the perimeter top plane by a cut of the depression perimeter wall.

As may be understood by a study of FIGS. 2 and 3, platform unit 10 and wall unit 12 are aligned with the wall panels 42 and 44 nesting into the perimeter channel 29. In the case of center wall units, the wall panel 44 nests into a midsection channel 31. Wall notches 45 socket over the platform bosses 34 to align the locking bolt receiver openings 36 and 47 respective to the boss 34 and notch 47. So aligned, the bolt tool socket 56 is accessible through the platform aperture 32 for sliding displacement of the bolt 50 for engagement of the bolt blade 54 through all of the lock apertures 36 and 47.

Dimensions of the locking bolts 50 are carefully coordinated with the notch 45 apertures 47 and the socket access aperture 49 for a material stretching insertion of the bolt 50 through the wall skin aperture 49 while the wall unit is still warm from original formation. Although the selected portion of the wall could be reheated for bolt insertion after forming and cooling, such reheating is usually less than desirable due to non-uniform heat distribution. While the wall material is still warm from the forming process, the apertures 47 and 49 are cut open and the edges of the aperture 49 are stretched to accept forced entry of the bolt. Due to the molecular memory of high density polymers, the material will return to its original shape and dimension as it cools thereby trapping the bolt between the wall skins 38 and 39.

When the bolt 50 engages the platform boss 34, the detent ridges 58 engage the bolt detent notches 57 to hold the bolt 50 in the desired position. Conversely, when the bolt 50 is withdrawn from the boss 34 and the span across the wall notch 45, only one notch and ridge combination holds the bolt 50 open.

Referring again to the perspective of FIG. 1, it is seen that a complete pallet assembly comprises two platforms 10, one for the lower platform and one for the cap. Both platforms are substantially identical with the corrugated floor skin 30 turned inwardly.

Between the inwardly opposite platforms 10 are four or six wall units 12, depending on the configuration used, with their respective panels 42 and 44 turned at 90° to each other about the hinge 40. The notched end of these wall units 12 socket into the perimeter channel 29 with the notches 45 spanning over and enveloping each boss 34. Slide bolts 50 are moved to the closed position with the bolt blade 54 traversing the notch 45 and the boss 34. This secures the wall units 12 to the two platforms 10 as an integral enclosure capable of supporting considerable tiered or stacking load. Importantly, the articles carried by the pallet are shielded from damage by stacking.

Although the preferred embodiment described does not totally enclose the internal volume of the pallet unit, it will be understood that substantially complete enclosure may be obtained by an outer wrap of fabric or film.

Figure 11:
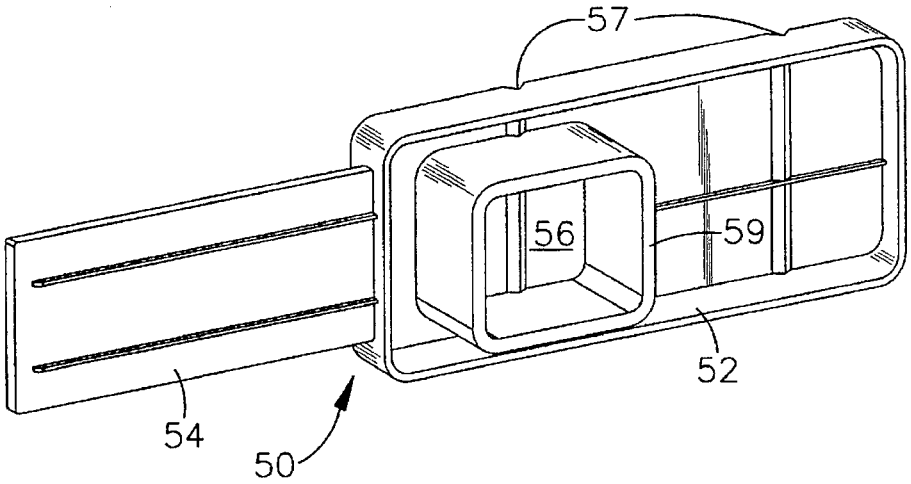
FIG. 11 is a perspective view of the front side of the invention slide bolt.
Figure 12:
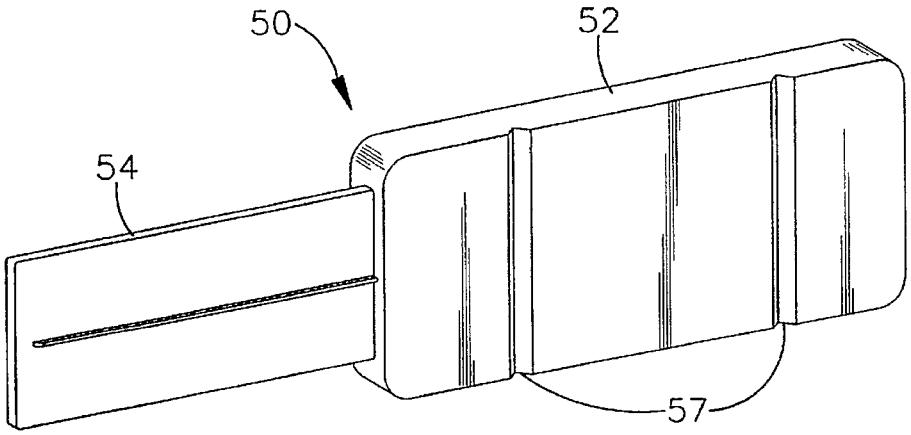
FIG. 12 is a perspective view of the back side of the invention slide bolt.

In a representative application of the invention illustrated by FIGS. 9–11, an insert 60 is molded of high density polymer to fit within the internal perimeter of the platform lip 27. Off-center slits 62 are included to accommodate the inside wall panels 44 to socket into the platform midsection channels 31 thereby assisting to stabilize and confine the insert on the platform.

Molded into the insert face are off-set pairs of automotive transmission unit cradles 64–67. Each cradle pair comprises a major cradle 70 and a minor cradle 72 aligned on respective centerlines 74–77. For efficient utilization of the loading area, the centerline 74 lies between an parallel with the adjacent centerline 77 and 75 whereby the platform width may be reduced by meshing the narrow transmission outdrives. This configuration is adapted to vertical stack, as illustrated by FIG. 11, for efficient return shipment.

Having fully disclosed our invention, those of ordinary skill in the art will readily perceive obvious modifications and equivalents. As our invention, however,

We claim:

1. A reusable shipping container comprising a pallet and a plurality of load bearing walls removeably secured to said pallet, said pallet being formed of first and second thermoplastic skin members, support blocks formed from first portions of said first skin member proximate of pallet corners to space remaining portions of said first skin member from a support plane, pallet floor ribbing formed in said second skin member, second portions of said first skin member being thermoplastically fused to corresponding portions of said second skin member, void space confined between said first and second skin members around the thermoplastically fused portions of said skin members, first open surface channels formed in said second skin member proximate of said pallet corners and substantially parallel with perimeter sides of said pallet connecting said corners, said second skin member having assembly boss elements formed within said first surface channels, each of said load bearing walls being formed of spaced apart, substantially parallel third and fourth thermoplastic skin members joined about a polygon perimeter having parallel top and bottom end edges, said third and fourth skin members separated along the top and bottom end edges by a distance corresponding to a fit within said first surface channels and having a receptacle notch formed therein to fit over a respective assembly boss element when socketed into a surface channel and, a slide bolt element confined between said third and fourth skin members for reciprocative movement guided through aligned apertures respective to said receptacle notch and said assembly boss elements to secure each load bearing wall to a pallet.

2. A reusable shipping container as described by claim 1 wherein said plurality of load bearing walls are disposed between an opposing pair of pallets, the bottom end edges of said walls being socketed into first surface channels respective to one pallet of said pair and top end edges of said walls being socketed into first surface channels respective to the other pallet of said pair, each of said walls being secured in a unit assembly with a respective pallet by slide bolt elements through cooperative receptacle notches and assembly boss elements.

3. A reusable shipping container as described by claim 1 wherein each of said load bearing walls comprises a pair of panels joined along a hinge axis that is substantially perpendicular to said parallel opposed end edges.

4. A reusable shipping container as described by claim 3 wherein said hinge axis comprises a relatively narrow strip of contiguously joined third and fourth skin members.

5. A reusable shipping container as described by claim 4 wherein said plurality of load bearing walls are disposed between an opposing pair of pallets, the bottom end edges of said walls being socketed into first surface channels respective to one pallet of said pair and top end edges of said walls being socketed into first surface channels respective to the other pallet of said pair, each of said walls being secured in a unit assembly with a respective pallet by slide bolt elements through cooperative receptacle notches and assembly boss elements.

6. A reusable shipping container as described by claim 5 wherein a load bearing wall is positioned about each corner of each pallet with a respective hinge axis connecting opposing corners of said opposing pair of pallets; and, each load bearing wall comprising a pair of panels radiating in respective directions from said hinge axis.

7. A reusable shipping container as described by claim 6 having intermediate load bearing walls disposed between adjacent corners respective to each pallet of said opposing pair of pallets.

8. A reusable shipping container as described by claim 7 having second open surface channels formed in said pallet second skin members adjacent to and substantially parallel with said pallet sides and intermediate of adjacent pallet corners.

9. A reusable shipping container as described by claim 8 having third open surface channels formed in said pallet second skin intermediate of adjacent pallet corners and substantially perpendicular to said pallet perimeter sides.

10. A reusable shipping container as described by claim 9 having the top and bottom end edges of the first of said pair of panels respective to a load bearing wall socketed in second surface channels respective to an opposing pair of pallets and top and bottom end edges of a second of said pair of panels being socketed in said third open surface channels of said opposing pair of pallets.

11. A reusable shipping container as described by claim 10 wherein substantially all load bearing wall panels between an opposing pair of pallets that are socketed in first and second surface channels may be secured by respective slide bolt elements through respective receptacle notches and assembly boss elements.

12. A reusable shipping container as described by claim 11 having an independent floor plate configured to be supported by the second skin member of one of the opposing pair of pallets, said floor plate having article anchoring cradles formed thereon.

* * * * *

UNITED STATES PATENT AND TRADEMARK OFFICE

CERTIFICATE OF CORRECTION

PATENT NO. : 5,651,463

DATED : July 29, 1997

INVENTOR(S) : Daniel E. Major and L. Bryan Yarnell

It is certified that error appears in the above-identified patent and that said Letters Patent is hereby corrected as shown below:

On the title page, please add Item [73]

--Assignee: Formall, INC., Knoxville, Tennessee--.

Signed and Sealed this

Twenty-ninth Day of December, 1998

*Attest:*

Bruce Lehman

BRUCE LEHMAN

*Attesting Officer*

*Commissioner of Patents and Trademarks*